US006017372A

United States Patent [19]

Berlowitz et al.

[11] Patent Number: 6,017,372

[45] Date of Patent: Jan. 25, 2000

[54] ALCOHOLS AS LUBRICITY ADDITIVES FOR DISTILLATE FUELS

[75] Inventors: Paul J. Berlowitz, E. Windsor, N.J.; Robert J. Wittenbrink, Baton Rouge, La.; Bruce R. Cook, Pittstown, N.J.

[73] Assignee: Exxon Research and Engineering Co, Florham Park, N.J.

[21] Appl. No.: 09/048,803

[22] Filed: Mar. 26, 1998

Related U.S. Application Data

[63] Continuation-in-part of application No. 08/798,383, Feb. 7, 1997, abandoned.

[51] Int. Cl.[7] ..... C10L 1/18

[52] U.S. Cl. ..... 44/451; 44/452

[58] Field of Search ..... 44/451, 452

[56] References Cited

U.S. PATENT DOCUMENTS

| | | | |
|---|---|---|---|
| 4,378,973 | 4/1983 | Sweeney | 44/451 |
| 4,518,395 | 5/1985 | Petronella | 44/451 |
| 4,527,995 | 7/1985 | Itow et al. | 44/452 |
| 5,324,335 | 6/1994 | Benham et al. | 44/451 |
| 5,385,588 | 1/1995 | Brennan et al. | 44/451 |
| 5,538,522 | 7/1996 | Ahmed | 44/451 |
| 5,545,674 | 8/1996 | Behrmann et al. | 518/715 |
| 5,624,547 | 4/1997 | Sudhakar et al. | 208/89 |
| 5,689,031 | 11/1997 | Berlowitz et al. | 585/734 |
| 5,807,413 | 9/1998 | Wittenbrink et al. | 44/451 |
| 5,814,109 | 9/1998 | Cook et al. | 44/451 |

FOREIGN PATENT DOCUMENTS

| | | | |
|---|---|---|---|
| 732964 | 6/1932 | France . | |
| 859686 | 12/1940 | France . | |
| 2650289 | 2/1991 | WIPO . | |
| 9623855 | 8/1996 | WIPO | C10L 1/14 |
| 9704044 | 2/1997 | WIPO | C10L 1/18 |
| 9714768 | 4/1997 | WIPO | C10L 1/08 |
| 9714769 | 4/1997 | WIPO | C10L 1/08 |

*Primary Examiner*—Jerry D. Johnson
*Attorney, Agent, or Firm*—Jay Simon

[57] ABSTRACT

Small amounts of primary, linear alcohols can be added to distillate fuels to improve the fuel's lubricity properties; particularly when the fuel has low or minimal lubricity.

11 Claims, No Drawings

ALCOHOLS AS LUBRICITY ADDITIVES FOR DISTILLATE FUELS

CROSS REFERENCE TO RELATED APPLICATIONS

Continuation-in-Part of U.S. Ser. No. 798,383, filed Feb. 7, 1997, now abandoned.

FIELD OF THE INVENTION

This invention relates to improving the lubricity of distillate fuels. More particularly this invention relates to the use of small amounts of primary alcohols as additives for improving distillate fuel lubricity.

BACKGROUND OF THE INVENTION

The continuing pressure from regulatory agencies around the world for reducing emissions, e.g., particulates, from diesel engines, as well as engines using distillate fuels, has led to regulations requiring, in particular, lower sulfur fuels, but also fuels having lower hetero-atom concentrations and lower aromatics concentrations. While lower, for example, sulfur levels in distillate fuels will improve emissions characteristics of the fuels, serious problems have been encountered in the maintenance of facilities for distributing the fuels to the public, e.g., pump failures, by virtue of the reduction in the inherent lubricity of the fuel as sulfur levels are reduced. Consequently, there is a need for low cost, benign additives that improve lubricity of distillate fuels.

SUMMARY OF THE INVENTION

In accordance with this invention, primary linear alcohols have been found to increase the lubricity of distillate fuels having low or minimal lubricity properties. For purposes of this invention, lubricity will be discussed in terms of the Ball on Cylinder (BOCLE) test run in the scuffing mode described by Lacy, P. I. "The U.S. Army Scuffing Load Wear Test," Jan. 1, 1994 which is based on ASTM-D 5001.

At present there are no prescribed lubricity minimums for distillate fuels, and these fuels do not generally have zero lubricity. There are, however, some generally accepted minimum lubricity values, see Table 1, for the diesel fuel, jet fuel, and kerosene fuels that are the subject of this invention,

TABLE 1

| FUEL | MINIMUM ACCEPTABLE LUBRICITY, BOCLE SCUFFING LOAD |
|---|---|
| diesel | 2500–3000 gms |
| jet | 1600–1800 gms |
| kerosene | 1600–1800 gms |

In these cases the minimal value for each fuel is a percent of a high reference value; in the case of diesel fuels, the minimum is about fifty percent of the high reference value, while in the cases of jet fuel and kerosene, the minimum value is about 25% of the high reference value. In all cases the reference value is obtained from the standard high reference fuel Cat 1-K, while the low reference is Isopar M solvent manufactured by Exxon Chemical Co., as described in the procedure.

Generally, alcohols are not known for providing lubricity improvement because of the competition with other components, e.g. sulfur bearing materials, for the surface to be lubricated. However, when the fuel is clean: when the fuel has only small amounts of naturally occurring lubricity components, the alcohols become lubricity enhancers because they have a higher heat of absorption for the surface than the paraffins or isoparaffins that make up the bulk of the fuel.

The distillate fuels applicable to this invention are those fuels that are heavier than gasoline and are useful as diesel, jet or kerosene fuels. These fuels may be obtained from normal petroleum sources as well as from syn fuels such as hydrocarbons obtained from shale oils or prepared by the Fischer-Tropsch or similar hydrocarbon synthesis processes.

Preferably, the lubricity of the fuel to which the alcohol is added, is less than about 50%, preferably less than about 35%, more preferably less than about 30%, still more preferably less than about 25% of the high reference value for diesels. For jets and kerosenes, the lubricity of the fuel is less than about 25%, preferably less than about 20%, more preferably less than about 15% of the high reference value.

Fuels from normal petroleum sources are generally derived from their appropriate distillate streams and may be virgin stocks, cracked stocks or mixtures of any of the foregoing.

Regardless of the fuel used in this invention, the key aspect is the desire to improve the lubricity of the fuel. Thus, while fuel having some lubricity can be used can used in this invention, it is the fuels that have minimal lubricity or are at the minimum accepted lubricity values or less that are preferred for use in this invention.

Particularly preferred fuels are those that have been severely hydrotreated to reduce hetero-atom concentrations and aromatics concentration. For example, distillate fractions having 500 ppm or less sulfur preferably 50 ppm or less, more preferably 10 ppm or less, still more preferably less than 1 ppm sulfur, will generally have poor lubricity. Such fuels will also have very low oxygen levels, substantially nil oxygen.

Particularly preferred fuels are those derived from shale oils and from the Fischer-Tropsch or related processes. For example, fuels obtained from the Fischer-Tropsch process, or related processes, e.g., Kolbel-Engelhardt, are generally free of sulfur or nitrogen components, and usually have less than about 50 ppm nitrogen or sulfur. Fischer-Tropsch processes, however, produce varying amounts of oxygenates and olefins and small amounts of aromatics. Thus, non-shifting Fischer-Tropsch catalysts, such as cobalt and ruthenium, containing catalysts, produce products low in oxygen and low in unsaturates, while shifting Fischer-Tropsch catalysts, such as iron containing catalysts, produce products having much larger amounts of unsaturates and oxygenate containing products. The general treatment of Fischer-Tropsch products includes the hydrotreatment of the distillate products, see for example, the Shell Middle Distillate Process, Eiler, J., Posthuma, S. A., Sie, S. I., Catalysis Letters, 1990, 7, 253–270, to remove all but traces of oxygen and sulfur containing materials, these products being referred to as clean products.

The diesel fuels that are one subject of this invention generally boil in the range 160–370° C., although there has been a trend, particularly in Europe and in California to lighter diesels, which co-incidentally are of lower viscosity and lower lubricity. For example, Swedish Class I diesel has a T 95% of 250° C. while the Class II has a T 95% of 295° C. and have no more than 50 w ppm sulfur and less than 10 wt % aromatics. The Swedish fuels are obtained from normal petroleum sources that have been heavily hydrotreated and are prime candidates for lubricity improvement in accordance with this invention.

Commercial jet fuels are generally classified by ASTM D 1655 and include: narrow cut Jet A1, a low freezing point variation of Jet A; and wide cut Jet B, similar to JP-4. Jet fuels and kerosene fuels can be generally classified as fuels boiling in the range 180–300° C.

The alcohols that are useful as lubricity additives are those that are linear, primary alcohols and can generally range from $C_7$+, preferably $C_9$+, more preferably about $C_9$ to about $C_{30}$ alcohols. Higher alcohols are generally more preferred, e.g., $C_{,2}$+, more preferably $C_{12}$–$C_{24}$, still more preferably $C_2$–$C_{20}$, still more preferably $C_{14}$–$C_{20}$, most preferably $C_{14}$–$C_{18}$ alcohols.

The use of lower alcohols, e.g., methanol, is to be avoided, mainly because, for example, a diesel or jet fuel with methanol is no longer a diesel or jet fuel because methanol is highly volatile (in addition to being highly toxic) and the flash point is lowered, consequently, the alcohol additive is essentially free of methanol e.g., less than 1.0 wt %, preferably less than 0.1, more preferably less than 0.05 wt % methanol.

The amount of alcohol to be added to the fuel is that amount necessary to improve the lubricity of the fuel. Thus, fuels that can have their lubricity improved can be improved by alcohol addition. Alcohol addition, however, should generally be at least about 0.05 wt % alcohol (≦35 ppm oxygen) preferably at least about 0.1 wt % alcohol, more preferably at least about 0.2 wt % alcohol (≦140 ppm oxygen). Generally, increasing the amount of alcohol added to the fuel will increase the lubricity of the fuel. Alcohol additions should, however, be less than 5 wt %, preferably less than 3 wt %, and more preferably less than about 1 wt %. Alcohol additions above 1 wt % usually run into a diminishing returns phenomena. Preferred alcohol addition levels are in the range of about 0.2 wt % to about 1 wt %, more preferably about 0.2 to 0.8 wt %.

The alcohols useful in this invention may be prepared by a variety of synthesis procedures well known to those skilled in the art. A preferred group of alcohols, preferred because they are essentially clean materials, can be prepared by the Fischer-Tropsch synthesis. For example, hydrogen and carbon monoxide can be reacted over a Fischer-Tropsch catalyst such as those containing iron, cobalt or ruthenium, preferably the latter two, and most preferably cobalt as, for example, described in U.S. Pat. No. 5,545,674 incorporated herein by reference. The $C_5$+ product is recovered by a flash to separate normally gaseous components from the hydrocarbon product, and from this hydrocarbon product a 500–700° F. stream can be recovered prior to hydrotreating which contains small amounts of the preferred $C_{12}$–$C_{24}$ primary, linear alcohols. Narrower cuts, e.g., 500–570° F. or 570–670° F. contain narrow alcohol fractions, e.g., $C_{11}$–$C_{14}$ and $C_{14}$–$C_{16}$, respectively. The alcohols can easily be recovered by absorption on molecular sieves.

In the use of alcohols as additives for distillate fuels, the lighter alcohols in the described range can have better effects as the gravity of the fuel decreases. For example, a $C_7$ linear, primary alcohol can be more effective with jet fuels than with diesel fuels where $C_{12}$+ alcohols show excellent results. Also, the additive preferably contains 90+% of alcohols, the remainder being inerts, e.g. paraffins, of the same carbon number range.

The use of oxygen containing products other than alcohols can have some lubricity effects, but are not nearly as efficient as the alcohols described herein. More importantly, materials containing carboxylic acid functionality, or which may readily lead to such functionality are to be avoided because they are corrosive in the environment in which the fuels of this invention are normally used. Consequently, the alcohol additive is essentially devoid of or free of carboxylic acids, for example, less than 1 wt %, preferably less than 0.5 wt %, more preferably less than about 0.1 wt % acids.

The following examples will serve to further illustrate but not limit this invention.

EXAMPLE 1

A series of alcohol spiked hydrocarbon fuels were tested for lubricity in the Ball on Cylinder (BOCLE) test run in the scuffing mode as described above. Alcohols were added to a model base fuel, Isopar M, a commercial product of Exxon Company, U.S.A. which has a boiling point, viscosity, and other physical parameters within the range typical of diesel fuels and is used as the "low reference" in the BOCLE test. Results are compared to the standard "high reference" fuel, CAT 1-K[(1)].

TABLE 2

| BASE FUEL | ADDITIVE | CONCENTRATION[(2)] | BOCLE RESULT[(3)] |
|---|---|---|---|
| Cat 1-K | None | — | 100% |
| Isopar M | None | — | 43% |
| Isopar-M | 1-Heptanol | 4800 | 46% |
| Isopar-M | 1-Dodecanol | 2400 | 68% |
| Isopar-M | 1-Hexadecanol | 2400 | 76% |
| Isopar-M | 1-Hexadecanol | 300 | 44% |

(1) Standard high reference filel specified in BOCLE procedure
(2) wt ppm
(3) Result reported as a % of the high reference: Result/Result of High Reference.

These data show, that $C_{12}$+ alcohols are effective in low concentration in effectively increasing the lubricity of the fuel.

Isopar M has essentially zero hetero-atoms, sulfur, nitrogen and oxygen.

EXAMPLE 2

A series of fuels were tested according to the procedure described in Example 1. Here the base fuel is a full boiling range, 250–700° F., diesel fuel derived entirely from Fischer-Tropsch synthesis obtained with a supported cobalt catalyst (FT). The fuel was completely hydrotreated with a conventional Co/Mo/alumina catalyst to remove all oxygenated compounds and had no measurable (<1 ppm) concentration of sulfur or nitrogen containing species. Data in Table 3 below show that this base fuel has better lubricity (64% of reference Cat 1-K) than the fuel of Example 1. In this fuel, the longer chain $C_{16}$ alcohol is a preferred additive.

TABLE 3

| BASE FUEL | ADDITIVE | CONCENTRATION[(1)] | BOCLE RESULT[(2)] |
|---|---|---|---|
| Cat 1-K | None | — | 100% |
| FT | None | — | 64% |
| FT | 1-Heptanol | 0.5% | 63% |
| FT | 1-Dodecanol | 0.5% | 63% |
| FT | 1-Hexadecanol | 0.5% | 82% |

(1) wt %
(2) Result reported as a % of the high reference: Result/Result of High Reference.

EXAMPLE 3

Here, several jet fuels were tested for lubricity in the BOCLE test. The data reproduced in Table 4 demonstrate the improved lubricity of a fuel containing terminal, linear alcohols as contrasted with either a conventional jet fuel or a synthetic jet fuel derived from a Fischer-Tropsch synthesis with no alcohols present. The fuels tested were:

A) U.S. Jet: a commercial U.S. approved jet fuel, treated by passage over atapulgus clay to remove impurities;

B) HI F-T: a Fischer-Tropsch derived fuel which is the product of a hydroisomerization/cracking reactor and which contains no measurable oxygenates or olefins. The fuel is distilled to a nominal 250–475° F.;

C) F-T: a Fischer-Tropsch derived fuel which is a mixture of raw F-T products, and HI reactor products containing approximately 1.8 wt. % $C_7$ to $C_{12}$ terminal, linear alcohols distilled to a nominal 250–475° F. cut point.

D) 40% HI F-T from (B)+60% U.S. Jet from (A); and

E) 40% F-T from (C)+60% U.S. Jet from (A).

The results are given in absolute grams of load to produce scuffing, and as a standard high reference fuel, Cat 1-K.

TABLE 4

| FUEL | ADDITIVE | CONCEN-TRATION(1) | BOCLE RESULT(2) | BOCLE RESULT(3) |
|---|---|---|---|---|
| A) US JET | None | — | 23% | 1600 |
| B) HI F-T | None | 0 | 19% | 1300 |
| C) F-T | None(3) | 1.8% | 34% | 2100 |
| D) | None | 0 | 21% | 1400 |
| E) | None(4) | 0.7% | 33% | 2100 |

Notes:
(1)wt %
(2)Result reported as a % of the high reference: Result/Result of High Referenced ×100
(3)Contains 1.8 wt %, listed in the third column, of byproduct $C_7$ to $C_{12}$ linear, tenninal alcohols.

(4) Contains 0.7 wt % of byproduct $C_7$ to $C_{12}$ linear, terminal alcohols.

These data thus show that by combining fuel C, which has good lubricity, with fuel A, a conventional jet fuel, the overall fuel lubricity of fuel A is improved; up to the level of fuel C despite a drop in concentration from 1.8 wt. % to 0.7 wt. %. Concentrations of the additive above 0.7 wt. %, it is found, does little to produce additional benefits.

EXAMPLE 4

Here, long chain, terminal alcohols from sources other than a Fischer-Tropsch process are added to a conventional jet fuel, i.e., fuel B of Example 3, and compared with the same jet fuel to which no alcohols are added, the results are shown in Table 5.

TABLE 5

| FUEL | ADDITIVE | CONCEN-TRATION(1) | BOCLE RESULT(2) | BOCLE RESULT(3) |
|---|---|---|---|---|
| B | None | 0 | 19% | 1300 |
| F | 1-Heptanol | 0.5% | 33% | 2000 |
| G | 1-Dodecanol | 0.5% | 33% | 2000 |
| H | 1-Hexadecanol | 0.05% | 32% | 2000 |
| I | 1-Hexadecanol | 0.2% | 37% | 2300 |
| J | 1-Hexadecanol | 0.5% | 44% | 2700 |

Notes:
(1)wt. %
(2)Result reported as a % of the high reference: Result/Result of High Reference
(3)In absolute grams of load to produce scuffing.

The results show a synthetic fuel, fuel B, to which specific alcohols have been added to produce fuels F, G, H, I and J. The addition of 1-heptanol or 1-dodecanol yields results nearly identical with the results for the Fischer-Tropsch derived fuel which contains these alcohols in similar concentrations. This demonstrates that the alcohols can be added to any fuel as an additive which is effective in improving lubricity. Also, the addition of a longer chain, $C_{16}$ hexadecanol, results in better lubricity. At only 0.05% hexadecanol gives a scuffing load approximately equivalent to $C_{12}$ alcohols, with higher concentrations proving additional benefits.

EXAMPLE 5

Fuels A, B, C, E, H and J, as shown in Table 6, were tested in the ASTM D5001 BOCLE test for aviation fuels, the results being shown in Table 6, confirming the scuffing BOCLE.

TABLE 6

| FUEL | Wear Scar Diameter |
|---|---|
| A | 0.66 mm |
| B | 0.57 mm |
| C | 0.54 mm |
| E | 0.53 mm |
| H | 0.57 mm |
| J | 0.54 mm |

These data show that the addition of the alcohol to the U.S. Jet fuel lowers the wear scar (E vs. A), as does the addition of $C_{16}$ alcohols to the HI Jet (J vs. B). Lower concentrations of alcohols (H) have little or no effect. The base lubricity for the F-T fuel with alcohols (C) is better than the Fischer-Tropsch fuel without alcohols (B).

EXAMPLE 6

The ability of tetrahydrofuran and 2-ethyl hexanol to improve the lubricity of a paraffinic Fischer-Tropsch derived (cobalt catalyzed Fischer-Tropsch) diesel fuel was tested using the BOCLE test. Comparative results to 1-hexadecanol (which is demonstrative of this invention), at 0.5 wt % additive in the fuel are shown in Table 7 below. Both tetrahydrofuran and the ethyl hexanol gave results that were insignificant in improving the lubricity of the fuel.

TABLE 7

| BASE FUEL | ADDITIVE | BOCLE RESULT(1) |
|---|---|---|
| Fischer-Tropsch Diesel | None | 27% |
| Fischer-Tropsch Diesel | 0.5 wt % tetrahydrofuran | 28% |
| Fischer-Tropsch Diesel | 0.5 wt % 2-ethyl hexanol | 35% |
| Fischer-Tropsch Diesel | 0.5 wt % 1-hexadecanol | 83% |

(1)Result reported as a % of the high reference: Result/Result of High Reference.

We claim:

1. A process for improving the lubricity of distillate fuels heavier than gasoline the fuel being derived from a non shifting Fischer-Tropsch process or from a hydrotreated fuel and having 500 ppm or less sulfur comprising adding to the fuel at least about 0.1 wt % and less than 5 wt % of $C_7$+ primary, linear alcohols.

2. The process of claim 1 wherein the sulfur content of the fuel is less than 50 ppm by wt.

3. The process of claim 2 wherein the fuel is a diesel fuel and has a lubricity by the BOCLE test of less than 50% of a high referenced value.

4. The process of claim 2 wherein the fuel is a jet fuel and has a lubricity by the BOCLE test of less than 25% of a high reference value.

5. The process of claim 3 wherein the alcohol is a $C_9$+.

6. The process of claim 3 wherein the lubricity is less than 35%.

7. The process of claim 1 wherein the alcohol is a $C_9$+.

8. The process of claim 7 wherein the fuel comprises a fraction boiling in the range 160–370° C.

9. The process of claim 1 wherein the fuel contains only trace amounts of oxygen.

10. The process of claim 1 wherein the alcohol additive is essentially devoid of carboxylic acid functionality.

11. The process of claim 1 wherein the alcohol additive is essentially free of methanol.

* * * * *